United States Patent [19]

Taylor

[11] Patent Number: 4,779,391

[45] Date of Patent: Oct. 25, 1988

[54] TERRACE HOUSE

[76] Inventor: Lawrence H. Taylor, P.O. Box 210577, Dutch Fork Sta., Columbia, S.C. 29221

[21] Appl. No.: 104,980

[22] Filed: Oct. 6, 1987

[51] Int. Cl.[4] ..... E04H 1/00

[52] U.S. Cl. ..... 52/236.3; 52/169.1

[58] Field of Search ..... 52/169.1, 169.3, 169.2, 52/79.1, 236.3

[56] References Cited

U.S. PATENT DOCUMENTS

| | | | |
|---|---|---|---|
| 3,678,639 | 7/1972 | Panitz | 52/79.1 |
| 3,708,931 | 1/1973 | Button | 52/169.2 |
| 3,841,036 | 10/1974 | Johnson | 52/236.3 X |
| 4,078,343 | 3/1978 | Moore, Jr. | 52/79.1 |
| 4,501,098 | 2/1985 | Gregory | 52/79.1 |

*Primary Examiner*—Carl D. Friedman

*Attorney, Agent, or Firm*—Kerkam, Stowell, Kondracki & Clarke

[57] ABSTRACT

A structure adopted to accommodate mobile homes set into a second floor terrace position that provides ground floor garage area and private family space below the mobile home position on the second floor terrace, with such structure being made to accept and use temporary and portable ramps that simplify and reduce the cost of putting mobile homes in and out of the structure.

2 Claims, 3 Drawing Sheets

TERRACE HOUSE

BACKGROUND OF THE INVENTION

As old as the technology of housing is, it is an evergreen in the world of science, because with each passing decade, new materials and new manufacturing techniques produce new forms of enclosure for mans living and work shelter.

The ubiquitous mobile home, growing more spacious and elegant every year, has regularly made great steps forward in its ability to offer an increasingly comfortable and practical way of life to its tenants.

The single aspect of mobile home development that has been most ignored, of what has now been renamed, "manufactured home" living, is the type of trailer park facility offered as a relatively permanent berth to these stationary giants of the road.

Trailer parks, in the kindest light, leave a great deal to be desired for a dignified, and secure way of life for, although there are some notable exceptions, the trailers of every color and shape are crowded together so there is no privacy whatever, and double parking of automobiles is almost the order of the day. There is no place to sit outside, beyond small muddy patches just inches off the sidewalk. Passers-by can usually see into the trailers, and surely hear every word, except those spoken in the back bedroom.

SUMMARY OF THE INVENTION

The development herein presented is completely unique in concept and design, and presents a comparatively simple way in which trailer tenants can still live, in close proximity, but with essential family privacy protected, and with security for person and possessions.

DESCRIPTION OF THE PREFERRED EMBODIMENTS

Figure 1:
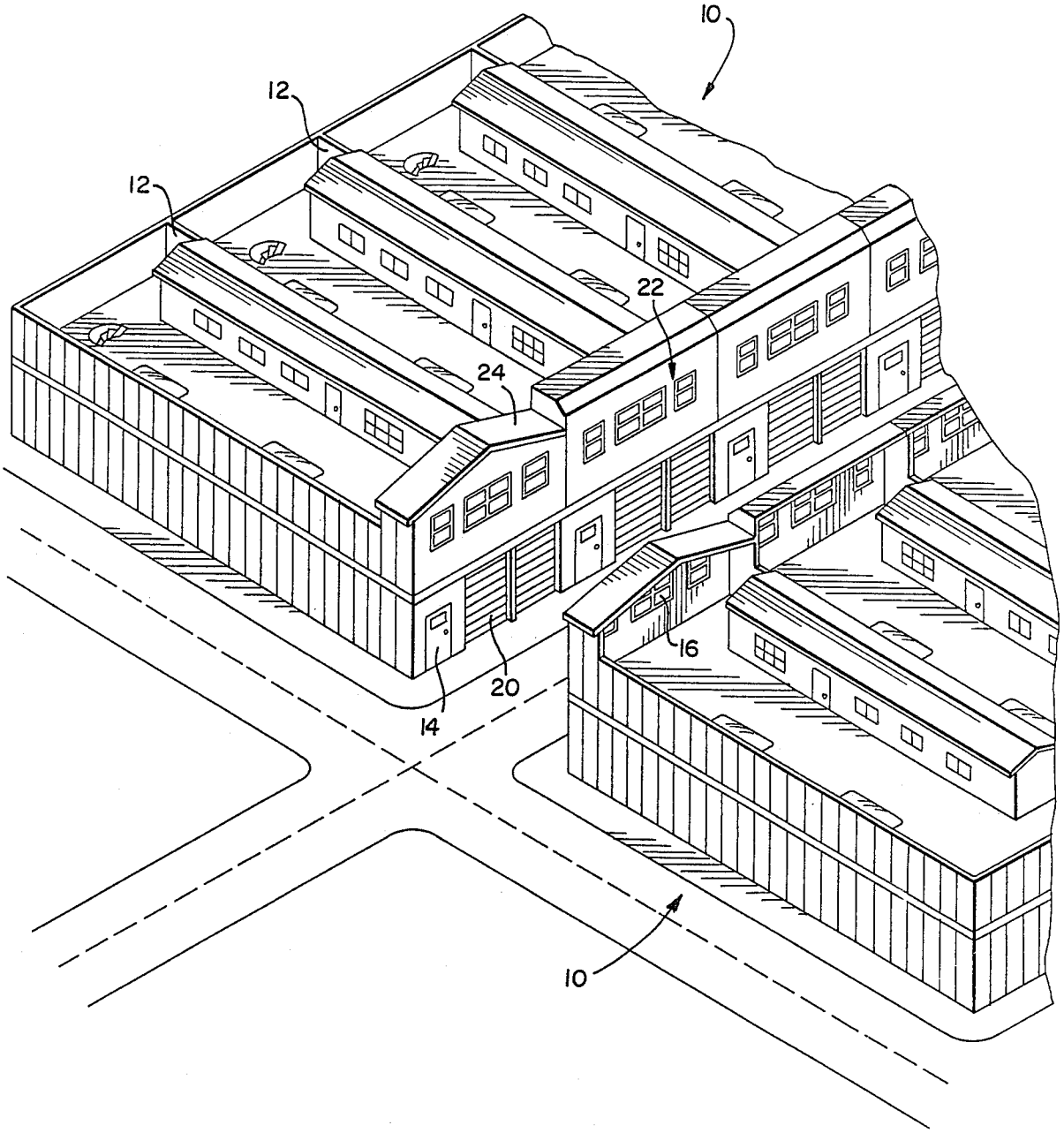
FIG. 1 is a perspective view of the terrace house of the invention.
Figure 2:
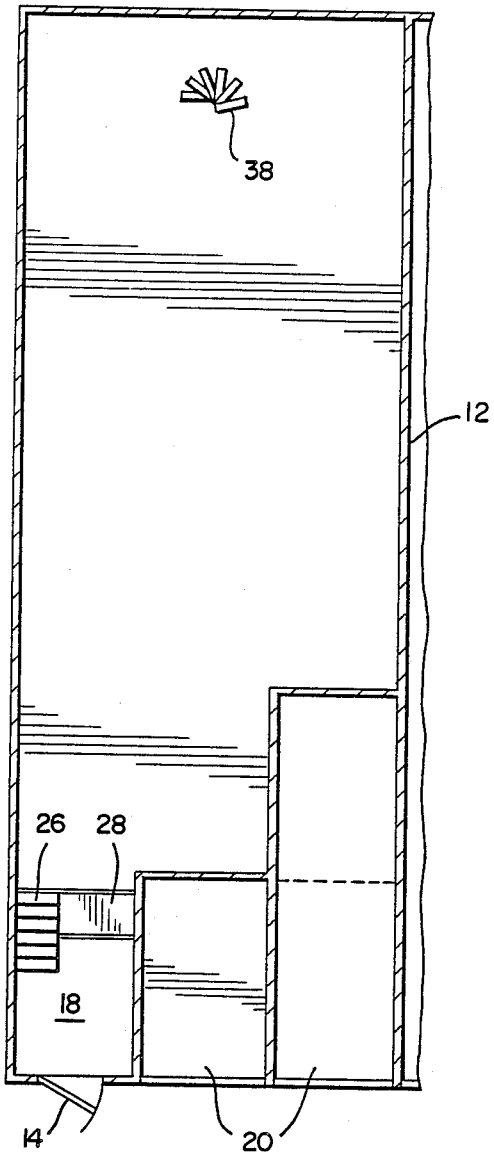
FIG. 2 is a plan view of the first floor of one terrace house invention.
Figure 3:
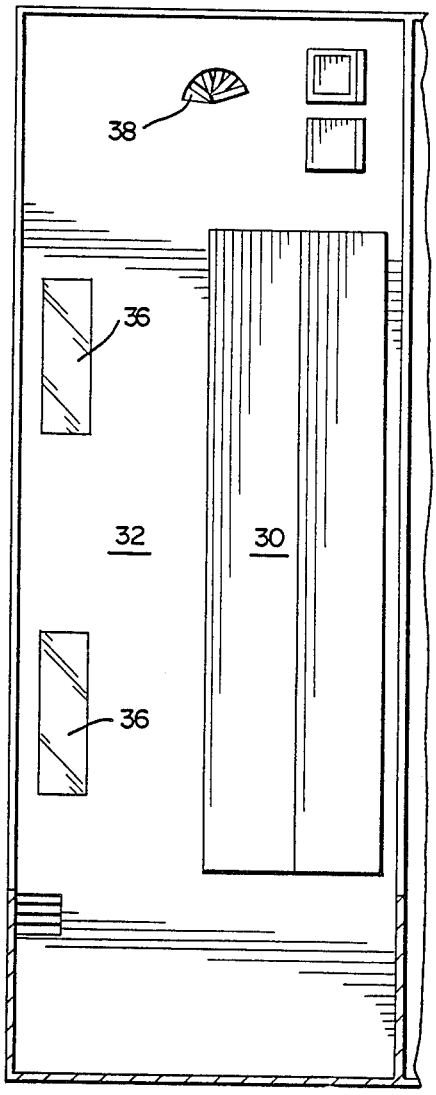
FIG. 3 is a plan view like FIG. 2 of the second floor.

These very essential objectives are achieved by building rows of what appear to be low 2-story townhouses 10 of approximately 30 feet width, with these houses sharing a common joining wall 12 as is common with townhouses. The houses have a front door 14 and standard window 16 for the front hall 18 about 10 feet wide and two one-car garage doors 20 taking up the remaining front footage at a width of 10 feet each per garage. The second floor has three or four windows 22 facing the sreet and there is a peaked roof front 24, mansard, cornice, or whatever is desired for a roof line.

On entering the house there is a small hall perhaps 10 feet square with a set of stairs 26 going up in stages at right angles with a landing 28 halfway up at the turn in the staircase.

On going up the stairs one finds a door that would normally open to the second floor, but which instead, opens out to what appears to be an open roof where a mobile home 30 is parked, but in a unique way, because its wheels are below deck level and the inside floor of the trailer is just one step up from the roof or terrace level 32 because the roof of the second floor is, in fact, a private terrace with the trailer set into depressed zone or open space 34, open only to the family that lives in the mobile home.

The spacious ground floor under the terrace is well lit because there are several large sky lights 36 in the terrace to give exceptionally good lighting to the ground floor. These sky lights can be made of industrial grade glass with a heavy flush mounted frosted surface that is regularly used for glass floored walkways.

The front part of the ground floor next to the front hall is used for garage space holding two or even three cars, two on one side and one on the other.

The back area of the first floor, connected with the terrace by a spiral staircase 38, is most spacious and can be used for a big family room and/or additional rooms for workshop, sleeping, and/or storage, particularly as the needs vary from family to family.

On the second floor, which is really the open terrace 32, the mobile home 30 sits under a removable and preferrably wooden peaked roof structure not shown, with awning to protect it from the weather, especially for air conditioning reasons. The front space 10 which appears from the street to be a peaked roof, is actually a small room roofed over that faces the terrace and acts like an outdoor living room because its roofed over with windows facing the street, but with an open wall facing the terrace which thus has a shielded cabanna like open porch with awning for bad weather or excess sun.

All of this is very simple structure work for those skilled in the art, but what is not simple or inexpensive, however, is the technique of putting the trailer 30 in or out of its special setting in the terrace house because a mobile home is a single load of 12 to 18 thousand pounds, 70 feet long, and 14 feet wide, which cannot be placed in the terrace position from the front with its center point 70 feet back from its lift point, unless a very large crane is used because the crane boom must clear the front of the house at 24 feet and the trailer is another 10 to 12 feet in height and the crane cannot operate for such height by turning sideways in a relatively wide street of even 50 feet.

The 70 foot trailer further more again from the front, cannot come straight into the house at street level, unless the street is wide enough to allow it to square off straight, or perpendicular to the plane of the front of the house, and the trailer cannot come into the house through a garage door because it's too high and too wide.

Figure 4:
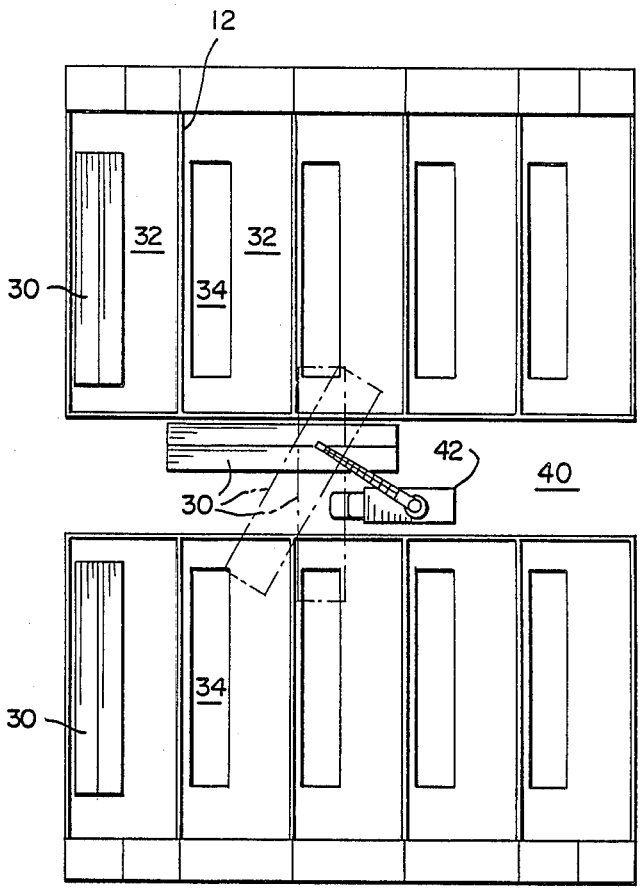
FIG. 4 is a plan view of terrace homes showing progressive steps in the progress ofinstalling a mobile home in the terrace position by use of a crane and sloping ramps showing that the use of a much smaller crane is possible because of the novel use of special temporary ramps to effect this move as the required reach of the crane from a narrow street is greatly reduced.
Figure 5A:
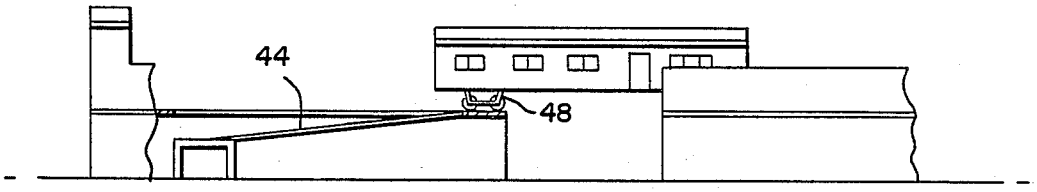
FIG. 5*a* shows the first step of the use of the installation ramp (sideview)
Figure 5B:
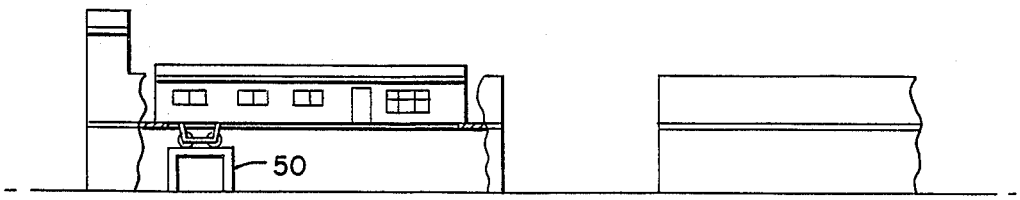
FIG. 5*b* shows the result of the use of an installation ramp with the mobile home in its resting position (sideview).

What has been done, therefore, to solve the problem of installing the mobile home 30 in the terrace house most efficiently at best cost is to use a very novel combination of cranework and building structure with temporary runners to fit the mobile home into its slot or depressed zone 34 from the back alley 40, which must be wide enough to accommodate the trailer and crane 42 side by side. As may be seen from the illustration, the crane parks next to the trailer in the back alley and lifts it perhaps 10 feet or less vertically so that it may be swung to a perpendicular relationship with the alley FIG. 4.

The crane then moves the trailer toward the front of the house by perhaps 10 feet so that the wheels are in the downward sloping ramp 44 leading to the permanent base support below terrace level for the wheels. Aternately, the temporary ramp 46 structure may be extended ten feet into the alley in lieu of having the crane move the trailer toward the front.

A small two wheel dolly 48 is put under the front of the trailer to support it forward of the trailer's midpoint and the trailer is then carefully eased, or rolled down the incline by means of cable until it comes to rest on the permanent base at which point two pier supports 50 are put under the front legs of the trailer, back wheels locked and fixed to the base, the temporary ramps removed and the space around the edges of the trailer where it touches the terrace deck are sealed in against the weather, so the downstairs area can be warm and dry. 0n removing the trailer the process is reversed.

I claim:

1. A terrace mobile home complex comprising a plurality of aligned two-story fronts, each containing a door, a stairway to the second story, windows, and at least one garage door, said two-story front open to the back, a deck extending front to rear, and said deck receiving mobile homes, one for each of the plurality of two-story fronts.

2. The terrace mobile home complex as defined in claim 1, wherein each mobile home is received in a well in-said deck, immediately adjacent the rear of the two-story front.

* * * * *